US006360731B1

(12) United States Patent
Chang

(10) Patent No.: US 6,360,731 B1
(45) Date of Patent: Mar. 26, 2002

(54) AXIAL-TYPE SUPERCHARGER

(76) Inventor: Yung-Yu Chang, No. 60, Mintsu Rd., Hsinshih Hsiang, Tainan Hsien (TW)

( * ) Notice: Subject to any disclaimer, the term of this patent is extended or adjusted under 35 U.S.C. 154(b) by 0 days.

(21) Appl. No.: 09/723,432

(22) Filed: Nov. 27, 2000

(51) Int. Cl.[7] ..... F02B 33/00
(52) U.S. Cl. ..... 123/559.1; 417/407
(58) Field of Search ..... 123/559.1, 566; 417/407

(56) References Cited

U.S. PATENT DOCUMENTS 4,406,125 A * 9/1983 Rahnke ..... 60/602
4,693,669 A * 9/1987 Rogers, Sr. ..... 415/143
5,063,904 A * 11/1991 Winkelmann et al. ... 123/559.1
5,074,115 A * 12/1991 Kawamura ..... 417/407 X
5,105,793 A * 4/1992 Winkelmann et al. ... 123/559.1

* cited by examiner

*Primary Examiner*—Hoang Nguyen
(74) *Attorney, Agent, or Firm*—William E. Pelton, Esq.

(57) ABSTRACT

An axial-type supercharger has a impeller with multiple impeller blades adapted to be rotatably mounted in the intake manifold, a motor with a shaft extending into an axial channel in the impeller to rotate the impeller; and a bracket adapted to be mounted on an end face of the intake manifold between the motor and the impeller. The supercharger further has an air filter directly mounted on the intake manifold upstream from the motor to filter out the pollutants in the air.

3 Claims, 6 Drawing Sheets

AXIAL-TYPE SUPERCHARGER

BACKGROUND OF THE INVENTION

1. Field of the Invention

The present invention relates to an axial type supercharger, and more particularly to a supercharger mounted on the intake manifold of an automobile. The supercharger is directly mounted in the intake manifold and driven by a motor to increase the pressure of the air in the combustion chamber to increase the output horsepower of the engine.

2. Description of Related Art

There are all kinds of superchargers available in auto shops to increase the output horsepower of an engine without changing the original engine design. Currently, the drive mechanism for all superchargers is either connected to the drive train or mounted in the exhaust path of the automobile. Due to the enormous pressure generated by the supercharger and applied to walls of the intake manifold, almost every automobile having a supercharger added after the automobile was built requires enhancement to the structure to accommodate the pressure from the supercharger. Otherwise, the mechanical parts of the automobile will easily loosen and malfunction.

There are two different kinds ol driver for the supercharger for an engine. One a belt or chain connected to the drive train to drive the impeller in the intake manifold to increase the output horsepower, and the other uses the exhaust gas from the engine to drive a turbine that rotates the impeller in the intake manifold. Either one of the driving methods requires enormous changes to the original design to alter the path of the air flow, which causes the following problems:

1. With the addition of the supercharger, the entire intake manifold needs to be remodeled or redesigned to withstand the extra load applied. Due to the enhancement to the structure and the addition of apparatus, the cost increases greatly. Furthermore, the additional space required to accommodate the added apparatus substantially increases the size of the automobile, which literally extends the cost required for the remodeling.

2. In addition to the foregoing problems, the turbocharger using the exhaust to drive a turbine that drives the impeller in the intake manifold requires that the distance between the exhaust pipe and the intake manifold be very close. Because of the proximity of the exhaust to the intake and the use of the turbine in the exhaust path, an extra cooler is required to cool the turbine and the intake manifold, which results in significant alternation to components in the engine compartment.

Accordingly, it is an important concern for the driver to decide whether a supercharger is necessary and whether the cost for the installation of the supercharger is affordable.

To overcome the shortcomings, the present invention tends to provide an improved supercharger to mitigate and obviate the aforementioned problems.

SUMMARY OF THE INVENTION

The primary objective of the axial-type supercharger in accordance with the present invention is to provide an improved motor-driven supercharger in the intake manifold to increase the pressure of the intake air to boost the output horsepower of the engine.

Another objective of the invention is to significantly reduce the cost for the supercharger so it is affordable to every driver.

Still, another objective of the invention is to provide a supercharger requires no alternation to the engine or engine compartment to accommodate installation, so that there is no concern about damaging the structure of the automobile.

Other objects, advantages and novel features of the invention will become more apparent from the following detailed description when taken in conjunction with the accompanying drawings.

DETAILED DESCRIPTION OF PREFERRED EMBODIMENT

Figure 1:
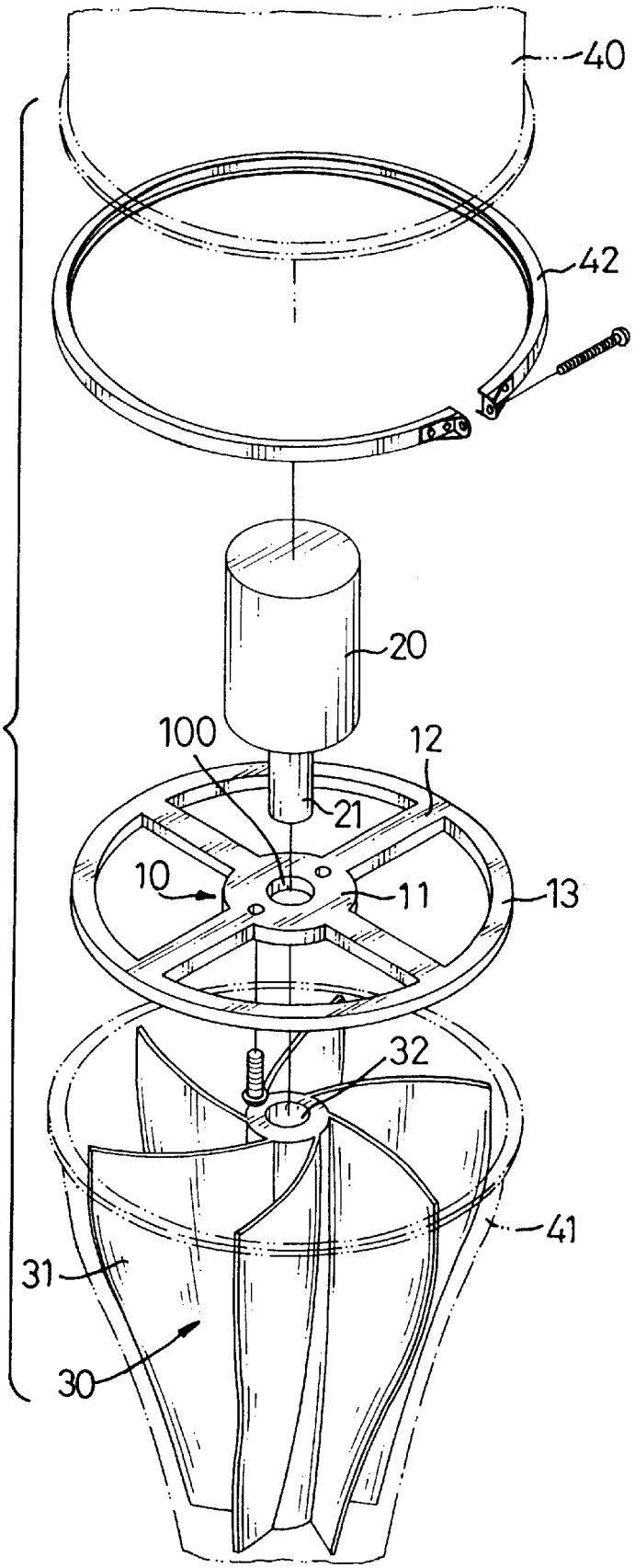
FIG. 1 is an exploded perspective view of the axial-type supercharger in accordance with the present invention.
Figure 2:
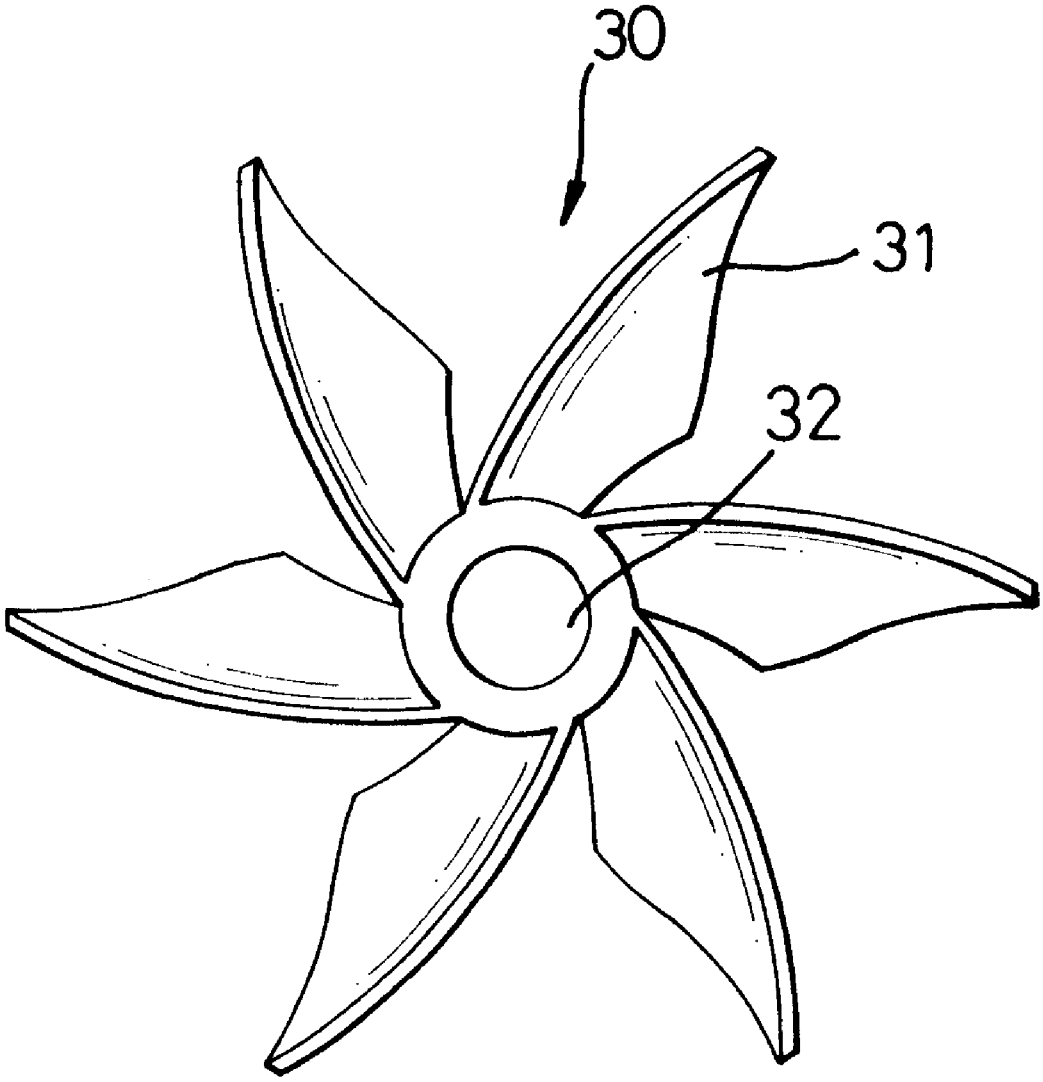
FIG. 2 is a top plan view of the impeller of the supercharger in FIG. 1.

With reference to FIGS. 1 and 2, a supercharger in accordance with the present invention has a bracket (10), a motor (20) and an impeller (30).

The impeller (30) is mounted in an intake manifold (40) of an automobile (not shown) and has multiple impeller blades (31) divergently extending out from the center of the impeller (30). The bracket (10) is mounted on an end face of a neck (41) of the intake manifold (40). The bracket (10) is comprised of multiple ribs (12) extending out radially from the center (11) of the bracket to engage with an inner wall of the intake manifold (40). Alternately, the bracket (10) may have a ring (13) formed at the distal ends of the ribs (12), which securely engages with the inner wall of the intake manifold (40).

The motor (20) has a shaft (21) extending axially through an opening (100) in the center (11) of the bracket (10) and into an axial channel (32) defined in the impeller (30). The motor (20) directly rotates the impeller (30) in the neck (41) of the intake manifold (40).

Figure 3:
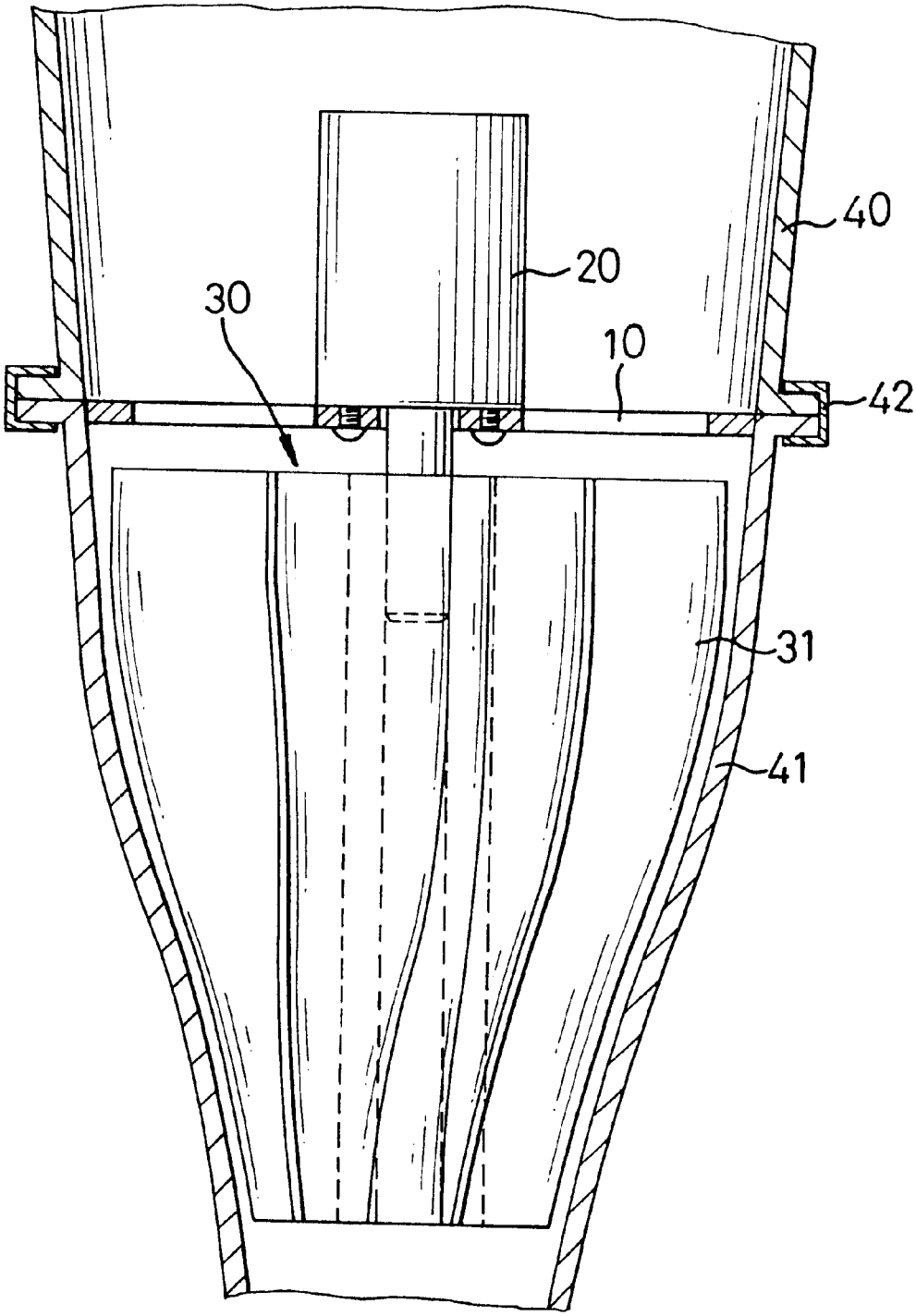
FIG. 3 is a side plan view in partial section of the supercharger in FIG. 1.
Figure 4:
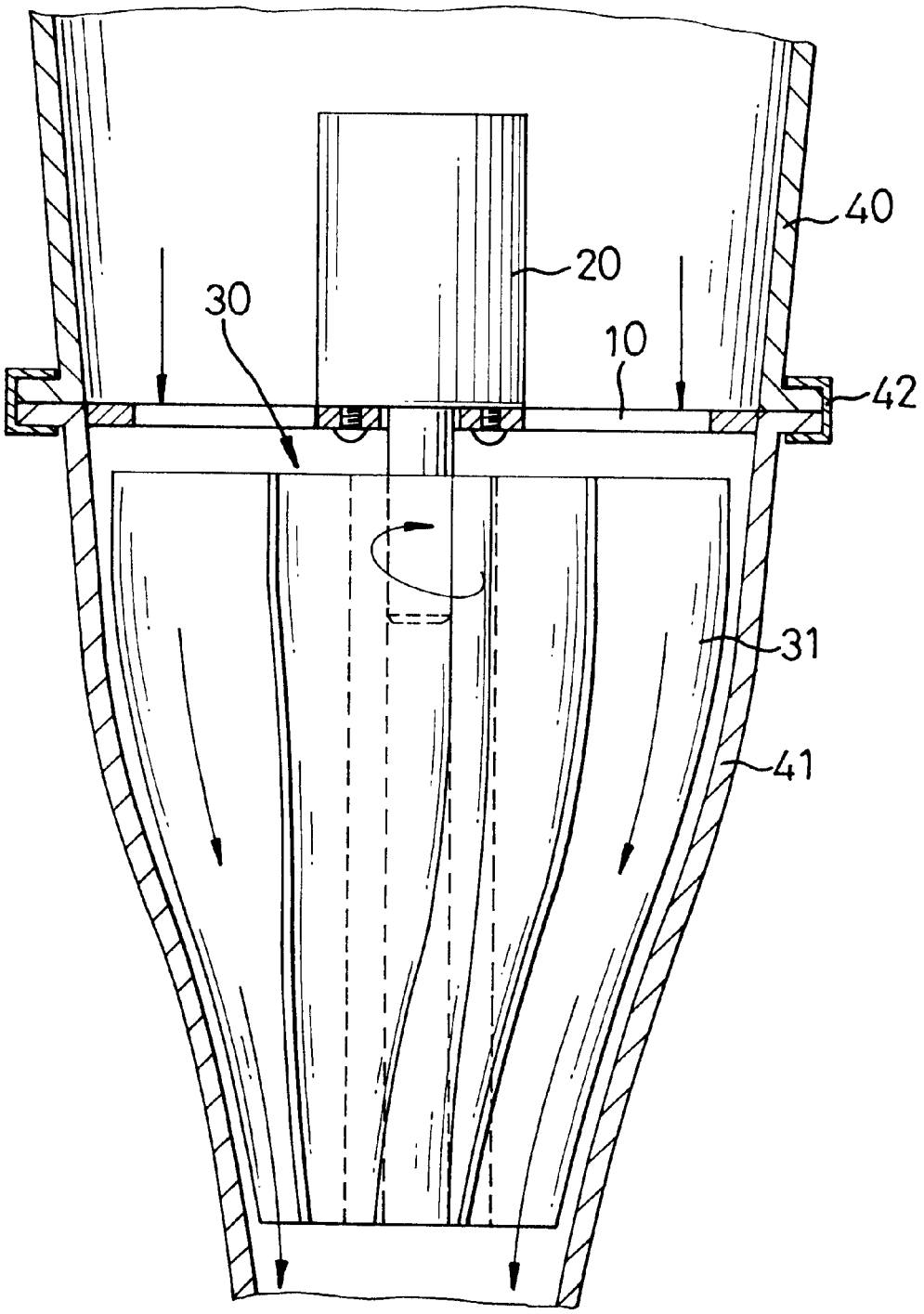
FIG. 4 is an operational side plan view in partial section of the supercharger in FIG. 1.

As shown in FIG. 3, the impeller blades (31) of the impeller (30) extend into the neck (41) a certain distance. The neck (41) is securely connected to the intake manifold (40) by an annular clamp (42). When the supercharger is operating, the air in the intake manifold (40) is drawn into the neck (41) by the rotating impeller (30), as shown in FIG. 4. The net flux and pressure of the intake air will increase due to the reduced diameter in the neck (41) at the outlet end of the impeller (30). The increased pressure of the air at the inlet to the combustion chamber (not shown) increases the volume of air in the combustion chamber. The additional volume of air directly equates to an increase in the volume of oxygen. With more oxygen in the combustion chamber, more fuel can be consumed in the combustion process, which releases more energy and generates more horsepower.

Figure 5:
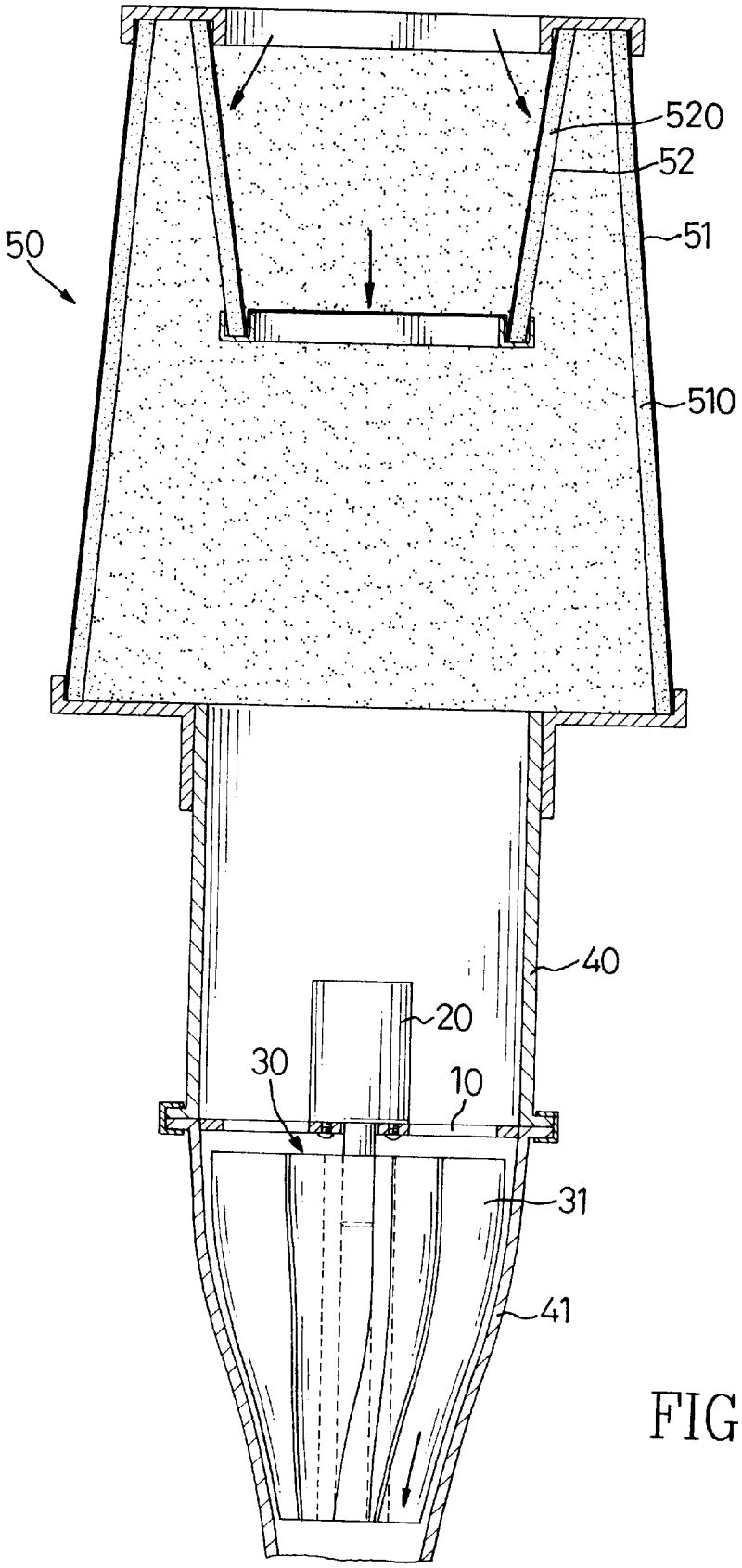
FIG. 5 is a side plan view in partial section of the supercharger in FIG. 1, wherein an air filter is added to filter out pollutants in the air.

With reference to FIG. 5, an air filter (50) is provided upstream from the motor (20) to filter out pollutants in the air. To increase the air filtering efficiency, a substantially conical first frame (51) with a first filter screen (510) and a substantially conical second frame (52) reversed with respect to the first frame (51) and having a second filter screen (520) are directly mounted on the intake manifold (40). With the two screens (510,520), the intake air in the intake manifold (40) is cleaned.

Figure 6:
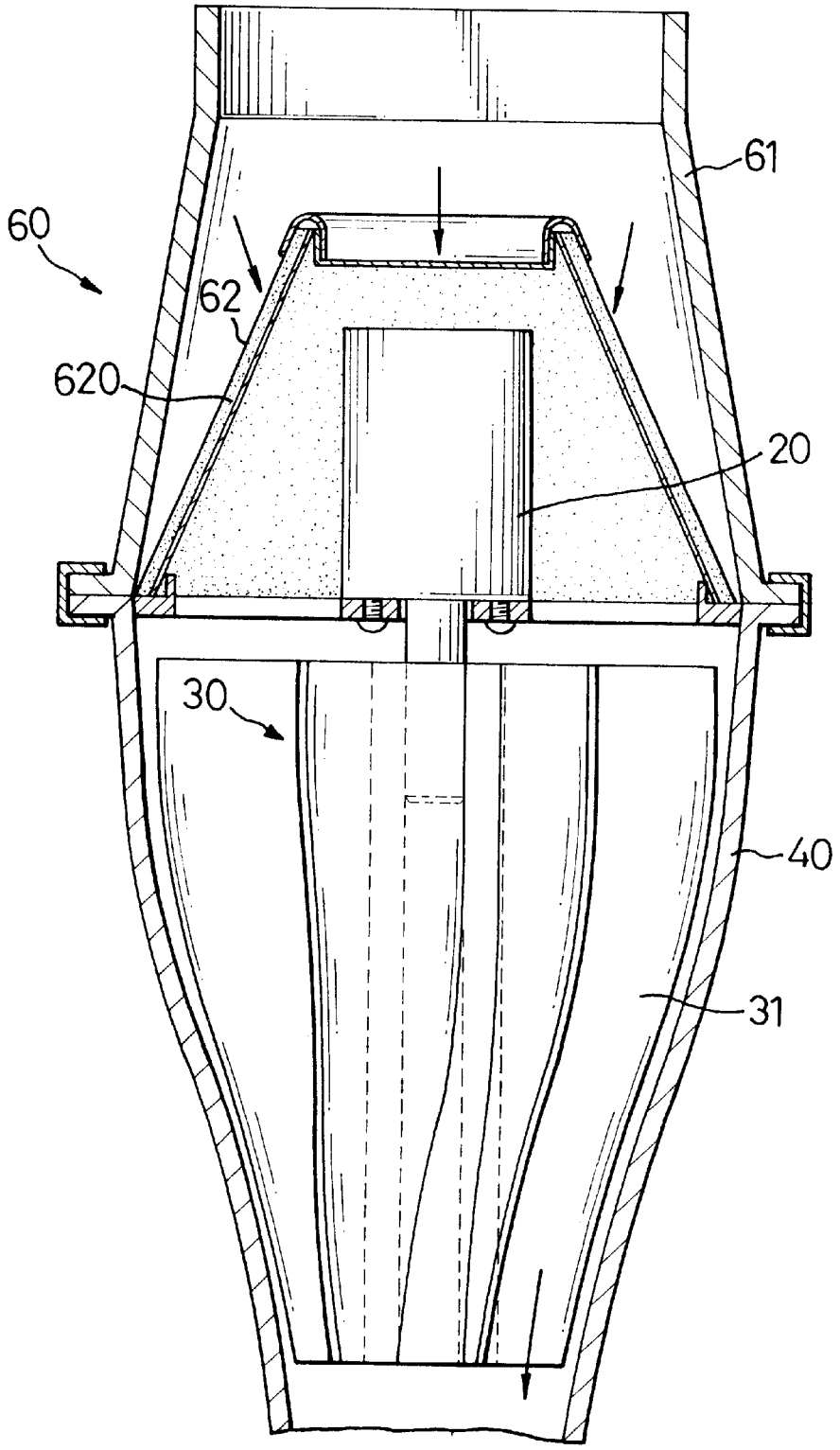
FIG. 6 is a side plan view in partial section of the supercharger in FIG. 1 with another preferred embodiment of the air filter provided to filter the intake air.

With reference to FIG. 6, another preferred embodiment of the air filter (60) has a casing (61) with a substantially conical frame (62) and a filter screen (620). The casing (61) is made of a strong lightweight, heat resistant material such as plastic. The casing (61) engages the intake manifold (40) to isolate the overheated air from the engine, and the screen (620) is able to filter the pollutants from the intake air.

The supercharger in accordance with the present invention has the following advantages.

1. The supercharger is mounted in the intake manifold (40) directly without any alternation to the original engine design, such that the cost and time for installation of the supercharger are reduced.

2. The supercharger is directly driven by the motor (20) rather than by a turbine driven by the engine exhaust, such that there is no need for the installation of a cooler to counter the increase in temperature caused by the exhaust.

3. Extra output horsepower is generated to increase the performance of the automobile.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An axial-type supercharger to be installed in an intake manifold comprising:

An impeller adapted to be rotatably mounted in the intake manifold with multiple impeller blades;

a motor with a shaft extending into an axial channel in the impeller to drive the impeller; and a bracket adapted to be mounted on an end face of the intake manifold between the motor and the impeller and having multiple ribs extending out radially from a center of the bracket and a ring formed to engage with each distal end of the ribs to be adapted to engage with an inner wall of the intake manifold.

2. The supercharger as claimed in claim 1 further comprising an air filter provided upstream from the motor and having a conical first frame with a first filter screen and a conical second frame reversed with respect to the first frame and provided with a second filter screen;

wherein the air filter is adapted to be directly mounted on the intake manifold to filter the intake air.

3. The supercharger as claimed in claim 1 further comprising an air filter provided upstream from the motor and having a casing and a conical frame with a filter screen;

whereby the casing is adapted to engage the intake manifold to isolate overheated air so the filter screen is able to filter the pollutants from the intake air.

* * * * *